United States Patent [19]

Jongewaard et al.

[11] Patent Number: 4,988,602

[45] Date of Patent: Jan. 29, 1991

[54] LIQUID ELECTROPHOTOGRAPHIC TONER WITH ACID CONTAINING POLYESTER RESINS

[75] Inventors: Susan K. Jongewaard; Mohamed A. Elmasry; Kevin M. Kidnie, all of St. Pau., Minn.

[73] Assignee: Minnesota Mining and Manufacturing Co., St. Paul, Minn.

[21] Appl. No.: 510,721

[22] Filed: Apr. 18, 1990

[51] Int. Cl.[5] ..... G03G 9/00

[52] U.S. Cl. ..... 430/115; 430/904; 430/945; 430/45

[58] Field of Search ..... 430/114, 115, 45

[56] References Cited

U.S. PATENT DOCUMENTS 4,946,753 8/1990 Elmasry et al. ..... 430/114

FOREIGN PATENT DOCUMENTS 2751440 6/1978 Fed. Rep. of Germany ..... 430/115

*Primary Examiner*—David Welsh

*Attorney, Agent, or Firm*—Donald M. Sell; Walter N. Kirn; Mark A. Litman

[57] ABSTRACT

Liquid toners for developing electrophotographic images contain dispersed toner particles which are based on a polymer with multi-characteristics. These particles comprise a thermoplastic resinous core with a Tg below room temperature, which is chemically anchored to an amphipathic copolymer steric stabilizer containing covalently attached groups of a coordinating compound which in turn are capable of forming covalent links with organo-metallic charge directing compounds and a thermoplastic ester resin that functions as a charge enhancing component for the toner. The toner particles so formed have advantageous properties of high charge/-mass, and good charge and dispersion stability.

30 Claims, No Drawings

LIQUID ELECTROPHOTOGRAPHIC TONER WITH ACID CONTAINING POLYESTER RESINS

BACKGROUND OF THE INVENTION

1. Field of Invention

The invention relates to multicolor toned electrophotographic images in which high quality colorimetric and sharpness properties are required. These properties are obtained using liquid toners. In particular, the invention relates to processes of development where two or more toner images of different colors are superimposed and then transferred together to a receptor surface. Applications include the demanding area of color halftone proofing.

2. Background of the Art

Metcalfe & Wright (U.S. Pat. No. 2,907,674) recommended the use of liquid toners for superimposed color images as opposed to the earlier dry toners. These liquid toners comprised a carrier liquid which was of high resistivity eg. $10^9$ ohm.cm or more, colorant particles dipersed in the liquid, and preferably an additive intended to enhance the charge carried by the colorant particles. Matkan (U.S. Pat. No. 3,337,340) disclosed that one toner deposited first may be sufficiently conductive to interfere with a succeeding charging step; he claimed the use of insulative resins (resistivity greater than $10^{10}$ ohm.cm) of low dielectric constant (less than 3.5) covering each colorant particle. York (U.S. Pat. No. 3,135,695) disclosed toner particles stably dispersed in an insulating aliphatic liquid, the toner particles comprising a charged colorant core encapsulated by a binder of an aromatic soluble resin treated with a small quantity of an aryl-alkyl material. The use of explicit dispersant additives to the toner dispersion is disclosed in U.S. Pat. No. 3,669,886.

The use of metal soaps as charge control and stabilizing additives to liquid toners is disclosed in many earlier patents (eg. U.S. Pat. No. 3,900,412; U.S. Pat. No. 3,417,019; U.S. Pat. No. 3,779,924; U.S. Pat. No. 3,788,995). On the other hand, concern is expressed and cures offered for the inefficient action experienced when charge control or other charged additives migrate from the toner particles into the carrier liquid (U.S. Pat. No. 3,900,413; U.S. Pat. 3,954,640; U.S. Pat. No. 3,977,983; U.S. Pat. No. 4,081,391; U.S. Pat. No. 4,264,699). A British Pat. No. (GB 2,023,860) discloses centrifuging the toner particles out of a liquid toner and redispersing them in fresh liquid as a way of reducing conductivity in the liquid itself.

In several patents the idea is advanced that the level of free charge within the liquid toner as a function of the mass of toner particles is important to the efficiency of the developing process (U.S. Pat. No. 4,547,449, U.S. Pat. No. 4,606,989). In U.S. Pat. No. 4,525,446 the aging of the toner was measured by the charge present and related it generally to the zeta potential of the individual particles. A related patent, U.S. Pat. No. 4,564,574, of the same assignee discloses that charge director salts were chelated onto the polymer binder by specially incorporated moieties on the polymer. It further discloses measured values of zeta potential on toner particles. Values of 33 mV and 26.2 mV with particle diameters of 250 nm and 400 nm are given. The disclosed objective of that patent is improved stability of the liquid toner. Attachment of the chelated salts directly to the polymer chain necessitates the presence of the charge in a random orientation off of the polymer. The charge would be generally distributed throughout the bulk and surface of the polymer. Finally in U.S. Pat. No. 4,155,862 the charge per unit mass of the toner was related to difficulties experienced in the earlier art in superposing several layers of different colored toners.

This latter problem was approached in a different way in U.S. Pat. No. 4,275,136 where adhesion of one toner layer to another was enhanced by an aluminum or zinc hydroxide additive on the surface of the toner particles.

The advantages of using binders comprising organosols (sometimes described as amphipathic particles) are disclosed in patents assigned to Philip A. Hunt Chemical Corp. (U.S. Pat. No. 3,753,760, U.S. Pat. No. 3,900,412, U.S. Pat. No. 3,991,226). Amongst the advantages is a substantial improvement in the dispersion stability of the liquid toner. The organosol is sterically stabilized with a graft copolymer stabilizer, the anchoring groups for which are introduced by the esterification reaction of an epoxy (glycidyl) functional group with an ethylenically unsaturated carboxylic acid. The catalyst used for the esterification is lauryldimethylamine or any tertiary amine. A similar treatment is found in U.S. Pat. No. 4,618,557 assigned to Fuji Photo Film except that they claim a longer linking chain between the main polymer and the unsaturated bond of the stabilizing moiety. Their comparative examples with the Hunt toners show that Fuji has improved the poor image quality found in the Hunt toners due to image spread, and they ascribe the improvement to the use of the longer linking chains. In both the Hunt and the Fuji patents charge director compounds when used are only physically adsorbed to the toner particles.

Diameters of toner particles in liquid toners vary from a range of 2.5 to 25.0 microns in U.S. Pat. No. 3,900,412 to values in the sub-micron range in U.S. Pat. No. 4,032,463, U.S. Pat. No. 4,081,391, and U.S. Pat. No. 4,525,446, and are even smaller in a paper by Muller et al, Research into the Electrokinetic Properties of Electrographic Liquid Developers, V. M. Muller et al, IEEE Transactions on Industry Applications, vol IA-16, pages 771–776 (1980). It is stated in U.S. Pat. No. 4,032,463 that the prior art makes it clear that sizes in the range 0.1 to 0.3 microns are not preferred because they give low image densities.

Liquid toners that provide developed images which rapidly self-fix to a smooth surface at room temperature after removal of the carrier liquid are disclosed in U.S. Pat. No. 4,480,022 and U.S. Pat. No. 4,507,377. These toner images are said to have higher adhesion to the substrate and to be less liable to crack. No disclosure is made of their use in multicolor image assemblies.

SUMMARY OF THE INVENTION

In its broadest terms the present invention relates to liquid toners comprising a carrier liquid, a pigment particle and a coordinated association of steric stabilizer and charge directing moiety in which liquid toner there is present at least 0.01% by weight of said liquid carrier of a charge enhancing thermoplastic ester resin.

The liquid toner composition of the present invention comprises a non-polar carrier liquid having a dispersion therein of toner particles comprising:

(a) a pigment particle, (b) thermoplastic polymeric particles about the surface of said pigment particle, said polymeric particles having copolymeric steric stabilizer groups adhered to its surface, and said copolymeric steric stabilizer having moieties attached thereto, said moieties being selected from the group consisting of coordinating groups and metal soap groups that form coordinate bonds with said coordinating groups, said dispersion of toner particles in the carrier liquid having a thermoplastic ester resin within the carrier liquid. The thermoplastic ester resin is an acid containing resin and must have an acid number between 1 and 200, may be dissolved in the carrier liquid (it must have a solubility in the carrier liquid of at least 0.01% by weight, preferably at least 0.05% by weight), and there it may further associate itself directly with the toner particles. This association may be electrical (charge attraction) or may be physical (e.g., deposited on the surface of the pigment and/or thermoplastic polymeric particles) or may be chemical.

DETAILED DESCRIPTION OF THE INVENTION

Conventional commercial liquid toners constitute a dispersion of pigments or dyes in a hydrocarbon liquid together with a binder and charge control agent. The binder may be a soluble resinous substance or insoluble polymer dispersion in the liquid system. The charge control agent is usually a soap of a heavy metal for positive toners or an oligomer containing amine groups such as OLOA for negative toners. Examples of these metal soaps are: Al, Zn, Cr, Ca salts of 3,5-diisopropylsalicylic acid; Al, Cr, Zn, Ca, Co, Fe, Mn, Va, Sn salts of a fatty acid such as octanoic acid. Typically, a very small quantity, from 0.01–0.1% wt/volume of the charge control agent is used in the liquid toner. However, conductivity and mobility measurements of toners, charged with any of the above metal soaps, showed a decrease in the charge/mass ratio as derived from conductivity measurements within a period of 1–3 weeks. For example, toners made of quinacridone pigment, stabilized with a polymer dispersion of polyvinylacetate in Isopar TM G and charged with A1(3,5-diisopropylsalicylate)$_3$ showed a conductivity of $3\times10^{-11}$ (ohm.cm)$^{-1}$ when freshly diluted with Isopar TM G to a concentration of 0.3 weight; upon standing for two weeks the conductivity dropped to $0.2\times10^{-11}$ (ohm.cm)$^{-11}$. Also, this toner would not overlay another cyan toner of the same formulation.

Liquid toners of the conventional art are not therefore suitable for use in the production of high quality digital imaging systems for color proofing. One of the major problems associated with these toners is the flow of the toner during imaging which results in the distortion of the produced images. Another problem is the desorption of the charge director, as well as the resinous binder, with time. Finally, the commercial toners are not suitable for use in multi-color overlay printing by a single transfer process.

The color liquid developer of this invention is a polymer dispersion in a non-polar carrier liquid which combines a number of important toner characteristics. The dispersed particles comprise a thermoplastic resinous core which is chemically anchored to a graft or block copolymer steric stabilizer. Such systems are commonly called organosols. The preferred organosol systems are described No. 07/279,424 filed Dec. 2, 1988 now U.S. Pat. No. 4,946,753. The core part of the particle has a $T_g$ preferably below 25° C. so that the particles can deform and coalesce into a resinous film at room temperature after being electrophoretically deposited onto a photoconductive substrate. Such film forming particles have been found to be useful for successive overlay of colors with greater than 90% trapping.

The stabilizer part of the particle, which is the soluble component in the dispersion medium, is an amphipathic graft or block copolymer containing covalently attached groups of a coordinating compound. The function of these groups is to form sufficiently strong covalent links with organometallic charge directing compounds such as metal soaps so that no subsequent desorption of the charge directing compounds occurs.

This invention discloses a thermoplastic ester resin having an acid number of less than 200 which is useful as a charge component for liquid electrophotographic developers. The preferred thermoplastic resins are those derived from hydrogenated rosin having an acid number of 1–200, a softening point in the range of 70°–110° C., and solubility in aliphatic hydrocarbon solvents.

The described resin apparently functions as a toner charge enhancing component when present in certain proportions to the metal soap in the toner formulation. The range of incorporation of the resinous material relative to the metal soap additive is 5–95% with preferred ranges of 30–85 percent. With the addition of the resinous material, the charging characteristics are enhanced in the toner, resulting in improved image characteristics, and increased toner conductivity.

In the compounding of the toner developer liquid according to this invention, the finely powdered colorant material is mixed with the polymer dispersion in the carrier liquid (organosol) described above, the thermoplastic ester resin described above and a metal soap and subjected to a further dispersion process with a high speed mixer such as a Silverson mixer to give a stable mixture. It is believed that the organosol particles agglomerate around each individual colorant particle to give stable dispersions of small particle size, the organosol and resin bringing to the combined particle its own properties of charge stability, dispersion stability, and film-forming properties.

In summary, the toners of the present invention comprise a pigment particle having on its exterior surface polymer particles usually of smaller average dimensions than said pigment particle, said polymer particles having charge carrying coordination moieties extending from the surface of said polymeric particles and acid containing polyester resins as charge enhancing agents. Polymeric particles in the practice of the present invention are defined as distinct volumes of liquid, gel, or solid material and are inclusive of globules, etc., which may be produced by any of the various known techniques such as latex, hydroxol or organosol manufacturing.

DISTINCTION OVER THE PRIOR ART

In the toners disclosed in the U.S. Pat. No. 3,753,760, U.S. Pat. No. 3,900,412, U.S. Pat. No. 3,991,226 (the Hunt patents), the presence of few parts per million of a tertiary amine in the liquid toner medium produces toners with very high conductivity especially when the toner is charged with a metal soap. This causes flow of the toner during imaging which in turn degrades the image. The high conductivity is derived from the protonation of the tertiary amine groups by the unsaturated carboxylic acid groups, thus giving ionic carriers in the liquid. Another problem associated with the use of tertiary amine is the high background in the non-imaged areas which is the result of negatively charged or non-charged particles. The esterification reaction of the glycidyl groups and the carboxylic groups usually does not go to completion under the reaction condition for making the organosol. The examples in these patents show that between 25% to 50% of the carboxylic acid groups could be esterified. In other words about 50% to 75% of the carboxylic acid still remain in the dispersion medium. During the dispersion polymerization reaction for making the latex, the unreacted unsaturated acid can copolymerize with either the core part of the particle or the stabilizer polymer or both at the same time. The tertiary amine also may become attached onto the polymer particle by hydrogen abstraction. The presence of carboxylic acid on the particle and tertiary amine in the liquid medium or on the particle would be expected to result in the formation of carboxylic anions on the particle which is a good source for a negative charge.

These problems have been eliminated from our toner through the use of a suitable catalyst other than tertiary amines or the use of other anchoring adducts that can be catalyzed with catalysts other than tertiary amines.

U.S. Pat. No. 4,618,557 draws attention to the poor performance of the prior art (Hunt) toners and relates it to the number of carbon atoms in the linking chain. We have found that the use of a tertiary amine catalyst for attaching an unsaturated group to the main chain of the stabilizing resin via linking groups is the main reason for the poor performance of Hunt's liquid developers. It is believed therefore that the liquid developers of U.S. Pat. No. 4,618,557 showed better quality images compared with Hunt's because they do not use a tertiary amine catalyst, rather than the claimed use of long linking groups. However, that patent failed to disclose anything related to the present invention. Toners according to the present invention are superior to the toners of U.S. Pat. No. 4,618,557 for these reasons:

(a) The prior art patent uses zirconium naphthenate as the charge director for their liquid toners. The metal cation is physically adsorbed onto the dispersed particles. This method usually results in a charge decay with time due to the gradual desorption of the metal soap from the particles. Toners according to the present invention do not suffer a charge decay because they are charged with metal chelate groups chemically attached to the resin particles.

(b) U.S. Pat. No. 4,618,557 uses mercury acetate, tetrabutoxy titanium or sulfuric acid as catalyts for the anchoring reaction. Some of the substances are toxic (such as mercury acetate) and must be removed from the toner. However, the patent uses subsequent steps to remove the catalysts by precipitation from a non-solvent such as acetonitrile or methanol. These solvents may be trapped in the stabilizing polymer and are very difficult to remove. The present invention selectively chooses catalysts and reactants so that there is no need for the purification step.

The toners disclosed in U.S. Pat. No. 4,564,574 are based on chelating polymers containing cationic groups neutralized with counter anions as the source of the charge. The polymer may be a homopolymer, copolymer, block copolymers or graft copolymer comprising a coordinating compound bound to the backbone of the polymer. The chelating polymer is prepared in solution by free radical polymerization reaction (using DMF as the solvent). After precipitating the polymer and redissolving it in a suitable solvent (THF), it is allowed to react with a metal cation. Those toners are prepared by milling a solution of the polymer in a suitable solvent (THF) with a pigment. The ratio of pigment to polymer is 1:4. Through this process, the polymer is adsorbed onto the surface of the pigment particles. Finally the blend is diluted with Isopar TM G to the proper concentration.

The polymers of U.S. Pat. No. 4,564,574 are prepared in a liquid medium which is a good solvent for the polymer, whereas our chelate polymers, are prepared by dispersion polymerization techniques wherein the liquid medium is not a good solvent for the dispersed polymeric particles. It is also well known that conducting a metal chelate reaction of a transition metal cation and a polymer containing coordinating groups in a liquid, which is a good solvent for the polymer, results in the formation of a crosslinked metal chelate gel. Some coordinating compound groups can lose a proton when they form ligands with a transition metal cation. This proton can neutralize the anion of the metal cation, thus reducing the overall charge of the material, which would be expected in the practice of the technology of that patent. The resulting metal chelate complex does not dissociate in a hydrocarbon solvent system.

Also, that patent claims that the use of a coordination compound in combination with any neutralizing anion such as halide, sulfate, p-toluenesulfonate, $C104^-$, $PF6^-$, $TaF6^-$ or any relatively large anion, would improve the dissociation of the corresponding ion pair in an apolar medium. Transition metal complexes or salts of these anions usually do not dissolve in a hydrocarbon liquid such as Isopar TM G. It is not apparent how they could dissociate in such a non-solvent system to give the charge on the particles necessary for good electrostatic imaging. The physical results in practice, showing low Zeta potentials for toner according to that invention, substantiate this analysis.

The toners of the present invention are based on polymer dispersions which are prepared by dispersion polymerization techniques in an aliphatic hydrocarbon liquid. The polymer dispersion generally consists of thermoplastic acrylic or vinyl core polymers and, pendant chelate groups attached to the soluble polymeric component of the particle. This component consists of a graft copolymer stabilizer containing metal chelate groups. The stabilizer polymer is chemically anchored to the insoluble part of the polymer (the core). Since these particles are in constant movement, cross-linking through the metal complex would be very difficult. In some cases crosslinking may take place in latices with high solid contents (>10%) due to the close distance between the particles. However, in latices with solid contents of less than 10%, cross-linking does not occur and the 1:1 complex is formed. In such a case only one counter ion (anion) of the metal salt is neutralized, while the other anions are still bound to the transition metal atom and dissociate in a hydrocarbon liquid. The new metal chelate latices of the present invention have been found to dissociate in a hydrocarbon liquid to give a high charge on the dispersed particle.

In U.S. Pat. No. 4,798,778 a liquid electrostatic developer containing modified resin particles are described. Also described are several procedures for preparation of the liquid developers which contain the resin particles.

The resin particles consist primarily of ethylene homopolymers or copolymers with certain types of esters, where the esters have certain substituents, e.g., hydroxyl, carboxyl amine, and acid halide. The resin particles once formed have an average particle size of less than 10 um.

The process for preparation of developers with the resins include mixing with the nonpolar fluid (Isopar TM G) at an elevated temperature to liquify the resin, cooling the formed particles, reacting the suspension with compounds selected from alkyl amine, alkyl hydroxide, amino alcohol, etc., and adding charge control agents to the suspension. The resultant toners carry a net negative charge as described in U.S. Pat. No. 4,798,778.

There are several differences between the present invention and the described patent including the solubility of the added resinous material, and the polarity of the resultant liquid electrostatic developer, and the less complicated procedure of simply incorporating the described material during milling.

It has been found that liquid toners formulated from a colorant thermoplastic ester resin and a polymer dispersion in a non-polar carrier liquid, wherein metal chelate groups are chemically attached to the polymeric moiety of the particles, provide high quality images for digital color proofing. The toners of the present invention may be characterized by the following properties:

1. There is a distinct charge component—a thermoplastic ester resin having an acid number of less than 200.
2. There is charging of the dispersed particles with a charge director not subject to desorption from the particles.
3. The polymeric latex particles provide fixing by film-forming at ambient temperature and thereby facilitate overprinting.
4. Dispersed particles are present in the toners which are stable to sedimentation.
5. The toner displays high electrical mobility.
6. High optical density is provided by the toner in the final image, and the toner (in particulate form) also displays high optical density.
7. A high proportion of conductivity is derived from the toner particles themselves as opposed to spurious ionic species.

This invention provides new toners based on a complex molecule with the above characteristics which alleviate many of the defects of conventional toners.

The component parts of the toner particles are a core which is insoluble in the carrier liquid, a stablilizer which contains solubilizing components and coordinating components, a charge director which is capable of chelation with the coordinating components, a thermoplastic ester resin useful as a charge component and the colorant. These will be described below in detail.

THE CORE

This is the disperse phase of the polymer dispersion. It is made of a thermoplastic latex polymer with a $T_g$ less than 25° C. and is insoluble or substantially insoluble in the carrier liquid of the liquid toner. The core polymer is made in situ by copolymerization with the stabilizer monomer. Examples of monomers suitable for the core are well known to those skilled in the art and include ethylacrylate, methylacrylate, and vinylacetate.

The reason for using a latex polymer having a $T_g$ <25° C. is that such a latex can coalesce, into a resinous film at room temperature. According to this invention, it has been found that the overprinting capability of a toner is related to the ability of the latex polymer particles to deform and coalesce into a resinous film during the air drying cycle of the electrophoretically deposited toner particles. The coalescent particles permit the electrostatic latent image to discharge during the imaging cycle, so another image can be overprinted. On the other hand, non-coalescent particles of the prior art retain their shape even after being air dried on the photoreceptor. The points of contact are then few compared to a homogenious or continuous film-forming latex, and as a result, some of the charges are retained on the unfused particles, repelling the next toner. Furthermore, a toner layer made of a latex having a core with a $T_g$ >25° C. may be made to coalesce into a film at room temperature if the stabilizer/core ratio is high enough. Thus the choice of stabilizer/(core+stabilizer) ratios in the range 20 wt. % to 80 wt. % can give coalescence at room temperature with core $T_g$ values in a corresponding range 25° C. to 105° C. With a core $T_g$<25° C. the preferred range of stabilizer/(core +stabilizer) ratio is 10 to 40 wt. %.

Color liquid toners made according to this invention on development form transparent films which transmit incident light, consequently allowing the photoconductor layer to discharge, while non-coalescent particles scatter a portion of the incident light. Non-coalesced toner particles therefore result in the decreasing of the sensitivity of the photoconductor to subsequent exposures and consequently there is interference with the overprinted image.

The toners of the present invention have low $T_g$ values with respect to most available toner materials. This enables the toners of the present invention to form films at room temperature. It is not necessary for any specific drying procedures or heating elements to be present in the apparatus. Normal room temperature 19–20° C. is sufficient to enable film forming and of course the ambient internal temperatures of the apparatus during operation which tends to be at a higher temperature (e.g., 25°–40° C.) even without specific heating elements is sufficient to cause the toner or allow the toner to form a film. It is therefore possible to have the apparatus operate at an internal temperature of 40° C. or less at the toning station and immediately thereafter where a fusing operation would ordinarily be located.

THE STABILIZER

This is a graft copolymer prepared by the polymerization reaction of at least two comonomers. These comonomers may be selected from those containing anchoring groups, coordinating groups and solubilizing groups. The anchoring groups are further reacted with functional groups of an ethylenically unsaturated compound to form a graft copolymer stabilizer. The ethylenically unsaturated moieties of the anchoring groups can then be used in subsequent copolymerization reactions with the core monomers in organic media to provide a stable polymer dispersion. The prepared stabilizer consists mainly of two polymeric components, which provide one polymeric component soluble in the continuous phase and another component insoluble in the continuous phase. The soluble component constitutes the major proportion of the stabilizer. Its function is to provide a lyophilic layer completely covering the surface of the particles. It is responsible for the stabilization of the dispersion against flocculation, by preventing particles from approaching each other so that a sterically-stabilized colloidal dispersion is achieved. The anchoring and the coordinating groups constitute the insoluble component and they represent the minor proportion of the dispersant. The function of the anchoring groups is to provide a covalent link between the core part of the particle and the soluble component of the steric stabilizer. The function of the coordinating groups is to react with a metal cation such as a cation of a metal soap to impart a permanent positive charge on the particles. Preferred comonomers containing preferred functional groups are described in U.S. Patent Application Ser. No. 07/279,424, filed Dec. 2, 1988.

THE CHARGE DIRECTOR

The metal soaps used as charge directors should be derived from metals such as transition metals which form strong coordinate bonds with the chelating groups of the stabilizer. Preferred metal soaps include salts of a fatty acid with a metal chosen from the group Al, Ca, Co, Cr, Fe, Zn, and Zr. An example of a preferred metal soap is zirconium neodecanoate (obtained from Mooney Co., with a metal content of 12% by weight).

CHELATION WITH METAL SOAPS

The reaction of latices containing coordinating groups is shown in the formula below, using acetylacetone as a representative example.

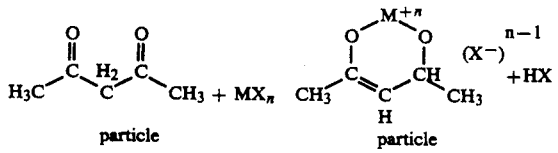

X = counter ion

This would dissociate in hyrocarbon liquid depending on X.

Latices containing a crown ether moiety complexed with a central metal atom such as K or Na, have been found to afford toners with very high conductivity and low zeta potential. They showed flow of the toner particles during imaging: We concluded that the use of a non-transition metal complex as the source of charge for toners did not give the high charge on the particles that has been found with the use of transition metal chelate latices.

Polymer dispersions having pendant chelate groups attached to the soluble polymeric component of the particle, have been found to react with soaps of heavy metals in aliphatic-hydrocarbon liquids to form metal chelate ligands on the surface of the dispersed particles. Since these particles are in constant movement, cross-linking through the metal complex is very difficult. However, cross-linking may take place in latices with high solid contents due to the close packing of the particles and their consequent restricted movements. In a diluted system, one may speculate that intermolecular cross-linking between the stabilizer chains, which are anchored to the same core, may occur while intramolecular cross-linking would be very difficult. For example, when a molar equivalent of zirconium neodecanoate is added to a polymer dispersion containing a molar equivalent of pendant salicylic acid groups, a gel formation was observed and the gel could not be dissolved in most organic solvents. Thus, it appears that cross-linking of the latex particles took place. However, after a few days the gel almost disappeared and the latex particles became redispersed in hydrocarbon liquids. This result indicates that there is a measurable ligand exchange between the cross-linked polymeric Zr-salicylate and the free zirconium neodecanoate. From these results, it is concluded that the 1:1 complex of Zr-salicylate is the most preferred. When the reverse addition was performed, gel formation was not observed. The latex particles looked very stable even after the mixture had been heated for several hours. Since gel formation under this drastic condition did not occur, it is reasonable to assume the 1:4 complex, is not favored when the reverse addition is performed. Because the Zr salt is in excess during the addition period, the 1:1 complex is favored for two main reasons:

(a) after adding the latex to the Zr salt and observing the stability of the latex during a period of 6 months, it was found that the latex was quite stable.

(b) measurements of the particle size of the latex before it was added to the Zr salt and then again after the addition showed no increase in the particle size. The particle size measurements were constant even after 6 months.

More proof for the possible formation of the 1:1 complex, was found in the conductivity measurements. The 1:4 complex of (Zr-salicylic acid) had poor solubility in Isopar TM G and did not contribute to a significant increase in the conductivity, while 1:1 or 1:2 or 1:3 ratios caused a high increase in the conductivity due to the solvated carboxylate counter ions of the fatty acid in Isopar TM G. A sample of the gelled latex was centrifuged and after it was washed with Isopar TM G several times, it was redispersed again in Isopar TM G to bring the concentration to about 0.3%. This sample showed a conductivity of $0.2\times10^{-11}$ (ohm.cm)-1. However, when a sample made by the reverse addition was processed in the same manner, it showed a conductivity of $8\times10^{-11}$ (ohm.cm)-1. This suggests that the sample that was made by the reverse addition is the 1:1 complex.

In some cases, the reaction of a metal soap with latices containing small amounts of chelating groups in a hydrocarbon liquid such as Isopar TM G have been determined by spectrophotometric means. The UV spectra of 3-methacryloxy-2,4-pentanedione ($2\times10$-4 M) in Isopar TM G show a strong and broad acetylacetone (acac) absorption band at about 281 nm due to the $\pi$-$\pi^*$ transition of the cyclic enol, C. T. Yoffe et. al., Tetrahedron, 18, 923 (1962) and a sharp absorption band at 225nm due to the methacrylate residue. This solution was titrated by adding increment amounts of a solution of zirconium neodecanoate in mineral oil (Mooney Co., obtained as 40% solids in mineral oil) in such a way that the molar concentration of the Zr salt ranged from $0.4\times10-4$ to $2\times10-4$ (mol/liter). After each addition, the solution was heated to 60° C. for five minutes and the U.V. spectrum was measured. As the concentration of the Zr salt increased, the intensity of the acac peak at 281 nm decreased and a new distinctive peak at 305nm appeared. When the molar concentrations of the acac-methacrylate and the Zr salt reached 1:1, the acac peak became a minimum and the new peak showed a strong absorption at 311.8 nm. The new peak corresponds to the Zr-acac chelate. The chelation reaction between zirconium neodecanoate and a latex of polyethylacrylate containing 1% pendant acac groups attached to the stabilizer polymeric chains was performed under the same conditions as those used with the acac-methacrylate. The UV spectra of the latex alone in Isopar TM G, showed a shoulder in the region between 250 nm and 340 nm with no distinctive peaks. As the concentration of the Zr salt was increased, a distinctive peak of 310.4 nm appeared. Addition of more Zr salt only increased the intensity of the peak. The disappearance of the shoulder and the appearance of the new peak at 310.4 nm is an indication of the formation of the Zr-acac chelate. The significance of using the spectrophotometric tool to determine the metal-chelate formation is that it can be used on-line as a means to detect the progress of the chelation reaction before manufacturing of the toners. Table (I) below shows the λmax of the formed metal-chelate groups by reacting a mixture containing zirconium neodecanoate and a latex containing acac groups with different concentrations in Isopar TM G. The acac latex was added to the Zr salt and the mixture was heated at 60° C. for 15 minutes after mixing.

TABLE I

| $C_1 \times 10^{-4}M$ | $C_2 \times 10^{-4}M$ | λmax (nm) |
|---|---|---|
| 2 | 0 | shoulder |
| 1.778 | 0.222 | shoulder |
| 1.6 | 0.4 | 304.4 |
| 1.33 | 0.666 | 307.6 |
| 1 | 1 | 308.4 |
| 0.666 | 1.333 | 310.4 |

$C_1$ is the concentration of the acac-latex based on the acas content.
$C_2$ is the concentration of the zirconium neodecanote.

In order to determine if the chelation reaction between zirconium neodecanoate and a latex containing acac groups attached to the core part of the latex would perform in the same manner, the experiment of Table I was repeated using a latex containing about 10% of the acac groups in its core. The UV spectra showed no distinctive peaks in the region between 250 nm and 350 nm. This experiment indicated that the reaction between the acac groups and the Zr salt would not take place if the chelating groups are attached to the insoluble polymeric core. This may be due to the inability of the Zr salt to penetrate the insoluble core of the latex.

The spectrophotometric results have been confirmed quantitatively be determining the wt % of a metal absorbed by a latex containing acac groups. The results are summarized in Table (II) below.

TABLE II

| Sample | acac ratio in the latex polymer | acac attach-ment | metal soap | found wt % metal | expected wt % metal |
|---|---|---|---|---|---|
| 1 | none | none | FeLau | 0.11 | 0.00 |
| 2 | 1% | stabilizer | " | 0.36 | 0.30 |
| 3 | 10% | core | " | 0.29 | 0.30 |
| 4 | none | none | ZrNeo | 0.10 | 0.00 |
| 5 | 1% | stabilizer | " | 0.39 | 0.50 |
| 6 | 10% | core | " | 0.19 | 0.50 |

where FeLau = Fe(laurate)$_3$ prepared as disclosed in the literature
and ZrNeo = Zr(neodecanoate)$_4$ Notes:
1. Samples were heated for 156 minutes at 70° C.
2. The mixture of the latex and the metal soap was centrifuged three times with fresh Isopar TM G.
3. The extracted latex polymer was dried at 0.2 mm & 50° C. for several hours.
4. The accuracy of the measured metal content may be within 20% of the correct value. However, the relative error should be constant for all the measured values.

From the above Table, it appeared that the wt % of the metal absorbed by a non-chelating latex is very small compared to that absorbed by a latex containing chelating groups. Also, the amount of metal absorbed by a latex with attached acac groups to the core is much less than that absorbed by a latex with attached acac groups to the stabilizer.

THERMOPLASTIC ESTER RESIN

The thermoplastic ester resin is incorporated into the toner prior to milling of the pigment. The thermoplatic ester resin has an acid number of less than 200. The preferred thermoplastic resins are those derived from hydrogenated rosin having an acid number of between 1 and 200, a softening point in the range of 70°-110° C., and solubility (e.g., at least 0.01% by weight) in aliphatic hydrocarbon solvents. The range of incorporation of the resinous material is at least 0.01% by weight of the carrier liquid or relative to the metal soap additive is 5-95% with preferred ranges of 30-85 percent. Examples of preferred resins:

Foral TM 105 - Rosin ester. Acid number 7-16, softening point 102°-110° C.

Foral TM 85 - Rosin ester. Acid number 3-10, softening point 80°-88° C.

Staybelite TM Ester 10 - Rosin ester. Acid number 10, softening point 80°-88° C.

The use of a thermoplastic ester resin enhances the charge component for liquid electrophotographic developers resulting in improved image characteristics compared to toner formulations without the charge enhancing resin additives.

The preferred thermoplastic ester resins for use in the present invention are derived from natural rosin. Rosin is primarily comprised of resin acids of abietic and primaric types, having the general formula $C_{19}H_{29}COOH$ and having a phenanthrene nucleus. They are unsaturated acids An unsaponified portion of the rosin can contain hydrocarbons and high molecular weight alcohols. The preferred thermoplastic ester resins are known derivatives of these rosins. The rosins may be hydroxylated (have hydroxyl groups added thereto by the reaction of monomers onto the rosin) and/or hydrogenated, and are esterified (on the acid group) to produce the thermoplastic ester resin. The commercially available tradenamed materials listed above are examples of these preferred resins.

LIQUID TONER CONDUCTIVITIES

Conductivity of a liquid toner has been well established in the art as a measure of the effectiveness of a toner in developing electrophotographic images. A range of values from $1.0\times10^{-11}$ mho/cm to $10.0\times10-11$ mho/cm has been disclosed as advantageous in U.S. Pat. No. 3,890,240. High conductivities generally indicate inefficient disposition of the charges on the toner particles and is seen in the low relationship between current density and toner deposited during development. Low conductivities indicate little or no charging of the toner particles and lead to very low development rates. The use of charge director compounds to ensure sufficient charge associated with each particle is a common practice. There has, in recent times, been a realization that even with the use of charge directors there can be much unwanted charge situated on charged species in solution in the carrier liquid. Such charge produces inefficiency, instability and inconsistency in the development. We have found (and have disclosed in our copending case U.S. Patent Application Serial No. 07/279,438, filed Dec. 2, 1988, titled LIQUID ELECTROPHOTOGRAPHIC TONERS) that at least 40% and preferably at least 80% of the total charge in the liquid toner should be situated and remain on the toner particles.

Suitable efforts to localize the charges onto the toner particles and to ensure that there is substantially no migration of charge from those particles into the liquid, and that no other unwanted charge moieties are present in the liquid, give substantial improvements. As a measure of the required properties, we use the ratio between the conductivity of the carrier liquid as it appears in the liquid toner and the conductivity of the liquid toner as a whole. This ratio must be less than 0.6 preferably less than 0.4 and most preferably less than 0.3. Prior art toners examined have shown ratios much larger than this in the region of 0.95.

CARRIER LIQUIDS

Carrier liquids used for the liquid toners of this invention are chosen from non-polar liquids, preferably hydrocarbons, which have a resistivity of at least $10^{11}$ ohm-cm and preferably at least $10^{13}$ ohm-cm, a dielectric constant less than 3.5 and a boiling point in the range 140° C. to 220° C. Aliphatic hydrocarbons such as hexane, cyclohexane, iso-octane, heptane, and isododecane, and commercially available mixtures such as Isopars TM G, H, K, and L of Exxon are suitable. However aromatic hydrocarbons, fluorocarbons, and silicone oils may also be used.

COLORANTS

A wide range of pigments and dyes may be used. The only criteria is that they are insoluble in the carrier liquid and are capable of being dipersed to a particle size below about a micron in diameter. Examples of preferred pigments:

Sunfast magenta
Sunfast blue (1282)
Benzidine yellow (All Sun Co.)
Quinacridone
Carbon black (Raven 1250)
Carbon black (Regal 300)

PARTICLE SIZE MEASUREMENTS

The latex organosol particle size and liquid toner particle size were determined with the Coulter N4 Sub-Micron Particle Size Analyzer. The N4 utilyzes the light scattering technique of photon correlation spectroscopy to measure the small frequency shift in the scattered light compared with the incident laser beam, due to particle translation or diffusion. (See B.Ch. "Laser Scattering", Academic Press, New York (1974) 11A).

The diffusion coefficient is the measured parameter which was related to the particle size. The N4 can accurately determine size and estimate size distributions for particles in the range 25–2500 nm. diameter.

CONDUCTIVITY MEASUREMENT

The liquid toner conductivity (k) was determined experimentally using a parallel plate capacitor type arrangement. The capacitor plate area is large compared to the distance between plates so that an applied voltage results in a uniform electric field ($E=V/d$; $V$=applied voltage; $d$=plate separation) applied to a dispersion when placed between the plates. The measurement consisted of monitoring the current (Keithley 6/6 Digital Electrometer) after the voltage was applied to the liquid toner "Progress in Organic Coatings", Kitahara 2, 81 (1973). Typically the current shows an exponential decay during measurement time. This behavior was due to the sweeping out of charged ions and charged toner particles.

The toner conductivity is determined from $1_o$ which is the current determined by extrapolation to time=0 (t=0) or initial conditions. The conductivity K is calculated from $k=i_o/AE$ where A is the area of the capacitor plate. The units in conductivity are in pmho/cm. Measurements of transmittance optical density (TOD) are taken at a specified time on a dried toner deposit. Values of charge/TOD (μC/TOD) are taken and obtained for a given time of deposition.

PREPARATION OF LIQUID TONER

An example of a suitable method and apparatus to prepare the liquid toner.

| Item | Description of Component |
|---|---|
| A | Organosol |
| B | Hydrocarbon Solvent |
| C | Metal Soap |
| D | Thermoplastic Ester Resin |
| E | Pigment |

Into a clean container are added items A, B, C, D, where they are mixed well. While mixing gently item E is added with continued mixing for 10 minutes. The mixture is placed on a mixer, i.e., Cowles dissolver, for 20 minutes. After mixing, it is placed in a sandmill or other suitable mill and charged with 20–30 mesh sand. The mill is run for a desired length of time to obtain desired particle size.

EXAMPLE OF APPLICATION TO ELECTROPHOTOGRAPHIC IMAGING

A description of suitable apparatus and processes in which the toners of this invention may be used to develop an electrophotographic image is to be found in our U.S. Pat. No. 4,728,983 which is hereby incorporated by reference. One embodiment of the present invention is as follows:

An organic photoreceptor comprising 40 parts of bis-(N-ethyl-1,2-benzocarbazol-5-yl)phenylmethane (BBCPM) as disclosed in U.S. Pat. No. 4,361,637, 50 parts of binder Makrolon TM 5705, 9.5 parts Vitel TM 222 polyester, and 0.5 part of an infrared sensitizing dye (a heptamethinecarbocyanine with a sensitizing peak at a wavelength of 825 nm, an electron accepting dye) was coated as a charge generating layer at about a 10 micron thickness on an aluminized 5 mil thick polyester substrate. This was topcoated with a release layer comprising a 1½% solution of Syl-off TM 23 (a silicone polymer available from Dow Corning Corporation) in heptane, and dried.

The photoreceptor was positively charged, exposed to a first half-tone separation image with a suitable imaging light and developed with magenta toner using an electrode spaced 510 microns away for a dwell time of 1 second with a toner flow rate of 500 ml/min. The electrode was electrically biased to 300 volts to obtain the required density without perceptible background. ,The excess carrier liquid was dried from the toner image. This magenta imaged photoreceptor was recharged, exposed to a second half-tone separation image with a suitable imaging light and developed with yellow toner under the same conditions as for the first image and dried. Again the photoreceptor was charged, exposed to a third half-tone separation image with a suitable imaging light source, developed with cyan toner, and dried.

A receptor sheet comprising a sheet of 3 mil phototypesetting paper coated with 10% titania pigment dispersed in Primacor TM 4983 to a thickness of 2 mils was laminated against the photoreceptor with a roller pressure of 5 pounds/linear inch and temperature of 110° C. at the surface. Upon separating the paper receptor, the complete image was found to be transferred and fixed to the paper surface without distortion.

The finished full color image showed excellent half-tone dot reproduction at 150 line screen of from 3 to 97% dots. The toners produced excellent image density of 1.4 ROD for each color. The toners also gave excellent overprinting with trapping of between 85-100% without loss of detail of the individual dots. The background was very clean and there was no evidence of unwanted toner deposit in the previously toned areas. The final image was found to be rub resistant and non-blocking.

EXAMPLE 1

The use of low acid number <10 resins during the milling process. Each mill base was milled on an Igarashi mill for 1 hour at 1000 rpm. After milling 10 grams of the solid black toner was diluted to a total volume of 2500 grams with Isopar TM G to obtain 0.4% solids and a 3/1 organosol to pigment ratio. To this mixture 0.83 grams (40%) Zr Ten Cem was added. The samples were prepared and tested as described in U.S. Pat. No. 4,728,983 using negative sensitometry.

| Mill base | | Components |
|---|---|---|
| Black 1 | 8.66 | grams Regal 300 carbon black |
| | 162.56 | grams organosol (15.7% solids - solvent is Isopar TM G) |
| | 6.0 | grams Zr Ten Cem (40% solids - solvent is VMP naptha) |
| | 65.5 | grams Isopar TM G |
| Black 2 | 8.66 | grams Regal 300 carbon black |
| | 162.56 | grams organosol (15.7% solids - solvent is Isopar TM G) |
| | 4.33 | grams Isopar TM 85 |
| | 6.0 | grams Zr Ten Cem (40% solids - solvent is VMP naptha) |
| | 78.5 | grams Isopar TM G |
| Black 3 | 8.66 | grams Regal 300 carbon black |
| | 162.56 | grams organosol (15.7% solids - solvent is Isopar TM G) |
| | 4.33 | grams Foral TM 105 |
| | 6.0 | grams Zr Ten Cem (40% solids - solvent is VMP naptha) |
| | 78.5 | grams Isopar TM G |
| Black 4 | 8.66 | grams Regal 300 carbon black |
| | 162.56 | grams organosol (15.7% solids - solvent is Isopar TM G) |
| | 4.33 | grams Stabellite TM Ester 10 |
| | 6.0 | grams Zr Ten Cem (40% solids - solvent is VMP naptha) |
| | 78.5 | grams Isopar TM G |

Data:

| Sample | Particle Size | 1 sec. Cond. | 1 sec. μC/TOD | 1 sec. TOD* | DOT Gain 10% | 20% | 30% | 40% |
|---|---|---|---|---|---|---|---|---|
| Black 1 | 750 | 75.0 | 0.1013 | 1.55 | 17 | 25 | 30 | 28 |
| Black 2 | 832 | 81.5 | 0.1297 | 1.27 | 12 | 25 | 28 | 27 |
| Black 3 | 660 | 80 | 0.1138 | 1.42 | 15 | 26 | 32 | 28 |
| Black 4 | 820 | 74.4 | 0.1240 | 1.21 | 17 | 28 | 32 | 29 |

*TOD (Transmittance Optical Density) measured with a MacBeth densitometer model TR524

The optimal particle size is 500–100 nm as measured by the Coulter model N4. Toner electrical measurements were carried out using a conductiveity cell. Typical conductivity values for liquid toners are in the range of 20–200 pmho/cm, and corresponding values for μc/TOD are in the range of 0.004–0.20 μcoul.TOD cm*2.

1 sec. cond units are pmho/cm sec. μc/TOD units are ucoul./TOD cm*2

EXAMPLE 2

The use of Foral TM 85 in a toner formulation compared to a sample without Foral TM 85. Both samples were milled using an Igarashi mill at 1000 rpm for 1 hour. After milling the samples were diluted to 0.5 % solids using Isopar TM G. All density measurements were taken using a Gretag densitometer D185.

The sample containing Foral 85 increases the toner μC/TOD.

| Sample # | | Formulation |
|---|---|---|
| 1 | 76.8 | grams Regal 300 carbon black pigment CAS #1333-86-4 |
| | 1956.7 | grams organosol (15.7% solids - solvent is Isopar TM G) |
| | 38.4 | grams Foral TM 85 |
| | 49.15 | grams Zr Ten Cem (40% solids - solvent is VMP naptha) |
| | 1079.0 | grams Isopar TM G |
| 2 | 76.8 | grams Regal 300 carbon black pigment CAS #1333-86-4 |
| | 1956.7 | grams organosol (15.7% solids - solvent is Isopar TM G) |
| | 49.15 | grams Zr Ten Cem (40% solids - solvent is VMP naptha) |
| | 117.4 | grams Isopar TM G |

Data:

Sam- Particle 1 sec. 1 sec. 1 sec. 30 sec.

-continued

| ple | Size (nm) | Cond. | μC/TOD | TOC* | TOD | mobility |
|---|---|---|---|---|---|---|
| 1 | 541 | 98.7 | 0.115 | 1.52 | 0.74 | 0.77 E-5 |
| 2 | 576 | 91.3 | 0.107 | 1.45 | 0.69 | 0.65 E-5 |

This example shows the sample containing Foral TM 85 (Sample 1) to give a slightly higher μ/TOD and increased mobility over the sample without the added resin. Another sample was prepared as the above except 12.29 grams additional Zr Ten Cem (40% solids) was added into the milled toner prior to diluting to 0.5% solids. The samples will be called 1A and 2A.

| Sam-ple | Particle Size (nm) | 1 sec. Cond. | 1 sec. μC/TOD | 1 sec. TOC* | 30 sec. TOD | mobility |
|---|---|---|---|---|---|---|
| 1A | 549 | 113.3 | 0.134 | 1.56 | 0.72 | 0.92 E-5 |
| 2A | 552 | 114.3 | 0.125 | 1.74 | 0.74 | 1.17 E-5 |

Samples 1 and 1A were imaged electrophotographically, with very similar imaging conditions as example 1 above. The samples were chosen such that the μC-TOD were close to 0.12.

Results:

| | DOT Gain | | | | |
|---|---|---|---|---|---|
| Sample | 10% | 20% | 40% | 60% | 80% |
| 1 | 14 | 23 | 27 | 26 | 15 |
| 2A | 18 | 26 | 30 | 27 | 16 |

The percent dot gain was reduced and improved with sample 1

1 sec. cond. units are pmho/cm 1 sec. μc/TOD units are μcoul./TOD cm*2 mobility units are cm*2/volt sec.

EXAMPLE 3

Magenta pigments were prepared with and without Foral TM 85. The toners were milled for 90 minutes at 2000 rpm using an Irarashi mill. All TOD measurements were taken with the Getag denistometer.

| Sample # | | Formulation |
|---|---|---|
| Magenta 1 | 6.24 | grams C. I. pigment red 48 |
| | 158.98 | grams organosol (24.96% solids - solvent is Isopar TM G) |
| | 3.12 | grams Foral TM 85 |
| | 3.99 | grams Zr Ten Cem (40% solids - solvent is VMP naptha) |
| | 87.67 | grams Isopar TM G |
| Magenta 2 | 6.24 | grams C. I. pigment red 122 |
| | 158.98 | grams organosol (24.96% solids - solvent is Isopar TM G) |
| | 3.12 | grams Foral TM 85 |
| | 3.99 | grams Zr Ten Cem (40% solids - solvent is VMP naptha) |
| | 87.67 | grams Isopar TM G |
| Magenta 3 | | Blend Magenta 1 with Magenta 2 at a 60/40 ratio |
| Magenta 4 | 195.6 | grams organosol (15.7% solids - solvent is Isopar TM G) |
| | 7.68 | grams C.I. pigment red 48 |
| | 4.915 | grams Zr Ten Cem (40% solids - solvent is VMP naptha) |
| | 116.7 | grams Isopar TM G |
| Magenta 5 | 195.6 | grams organosol (15.7% solids - solvent is Isopar TM G) |
| | 7.68 | grams C.I. pigment red 122 |
| | 4.915 | grams Zr Ten Cem (40% solids - solvent is VMP naptha) |
| | 116.7 | grams Isopar TM G |
| Magenta 6 | | Mix together 163.24 grams Magenta 4 above and 115.36 grams Magenta 5 above and 1.4 grams of toner solution (sample 1) in Example 2 above. |

| | | Formula | |
|---|---|---|---|
| | | Magenta 3 | Magenta 6 |
| 1 sec. cond. | | 66.1 | 43.0 |
| 1 sec. μC/TOD | | 0.1535 | 0.0862 |
| 1 sec. TOD | | 1.04 | 0.95 |
| 30 sec. TOD | | 0.52 | 0.42 |
| Mobility | | 1.35 E-5 | 1.52 E-5 |
| Foral TM 85/pigment ratio | | 0.5 | 0.0 |
| Electrophotographic Imaging Data: | | | |
| Dev. voltage | | 290 | 210 |
| Background Voltage | | 90 | 90 |
| TOD Uniformity | | ±0.05 | ±0.10 |
| DOT gain - | 10% | 17 | 15 |
| | 20% | 22 | 22 |
| | 40% | 28 | 24 |
| | 60% | 29 | 25 |
| | 80% | 17 | 15 |
| Quality | | Low edge cloud slight tails no window framing | Low edge cloud slight tails window framing present |
| DOTS | | 2*/99** | 2*/98** |

. 1 sec. cond units are pmho/cm
. 1 sec. μc/TOD units are μcoul./TOD cm*2
. mobility units are cm*2/volt sec.
*smallest dot observed
**largest dot observed This example demonstrates that the magenta pigment with the thermoplastic ester resin gave an increased μ/TOD and improved image uniformity.

EXAMPLE 4

A 25% solids solution of Foral TM 85 in Isopar TM G was prepared and evaluated for conductivity. The sample did not show any significant conductance.

EXAMPLE 5

To 5 grams of Magenta 6 above (Example 3 ), 0.3 grams of Foral 85 (25% solution in Isopar TM G) was added and mixed well by swirling. To this mixture 159.4 grams if Isopar TM G was added to obtain a 0.4% solids mixture. The sample was analyzed for its nonfunctional properties.

| | Results for Foral TM 85 + Magenta 6 |
|---|---|
| Foral TM 85/pigment ratio | 0.50 |
| 1 sec. conductivity | 32.9 |
| 1 sec. μC/TOD | 0.0712 |
| 1 sec. TOD | 0.99 |
| 30 sec. TOD | 0.38 |
| Mobility | 1.76 E-5 |

As can be seen from this example compared to Example 3 above. The addition of Foral TM 85 after milling does not show the same increases in μC/TOD as indicated by the samples milled with Foral TM 85 (samples 1 and 1A).

1 sec. cond. units are pmho/cm sec. μc/TOD units are μcoul./TOD cm*2 mobility units are cm*2/volt sec.

DESCRIPTION OF MATERIALS USED Foral TM 105:

Rosin ester. acid number 7-16, softening point 102°-110° C. made by Hercules Co. Foral TM b 85:

Rosin ester. acid number 3–10, softening point 80°–88° C. made by Hercules Co. Staybelite TM ester 10:

Rosin ester. acid number 10, softening point 80°–88° C. made by Hercules Co. Zr Ten Cem:

Zirconium Neodecanoate, made by Mooney Chem. Inc.

What is claimed:

1. A liquid toner for developing an electrostatic image comprising chelating copolymer particles dispersed in a non-polar carrier liquid, said chelating copolymer particles comprising a thermoplastic resinous core having a Tg of 25° C. or less and is insoluble or substantially insoluble in said carrier liquid, and chemically anchored to said core a copolymeric steric stabilizer soluble in said carrier liquid and having covalently attached thereto moieties of a coordinating compound and at least one metal soap compound derived from metals which form strong coordinate bonds with said moieties, said stabilizer being chosen from the classes of block and graft copolymers, and a thermoplastic ester resin present in an amount equal to 5–95% by weight of said metal soap compound, said resin is an acid containing resin and has an acid number of between 1 and 200.

2. A liquid toner as recited in claim 1 wherein a ratio of conductivities of said carrier liquid in said liquid toner and of said liquid toner is less than 0.6.

3. A liquid toner as recited in claim 1 wherein the carrier liquid comprises a hydrocarbon liquid having a boiling point in the range 140° C. to 220° C., a resistivity of more than $10^{11}$ ohm-cm, and a dielectric constant less than 3.5.

4. A liquid toner as recited in claim 3 wherein said carrier liquid has a resistivity of at least $10^{13}$ ohm-cm and said resin has a softening point of from 70° to 100° C.

5. A liquid toner as recited in claim 1 further comprising colorant particles which when combined with said chelating polymer particles give resultant particles of average diameter between 0.1 micron and 1.5 micron.

6. A liquid toner as recited in claim 5 wherein said colorant particles are selected from the group consisting of Sunfast magenta,
Sunfast blue (1282),
Benzidine yellow (All Sun Co.),
Quinacridone,
Carbon black (Raven 1250)
Carbon black (Regal 300),
Perylene green.

7. A liquid toner as recited in claim 1 wherein said resinous core is derived from monomers selected from the group consisting of ethylacrylate, mehylacrylate, and vinylacetate.

8. A liquid toner as recited in claim 1 wherein said resin is soluble in aliphatic hydrocarbon solvents, has an acid number between 1 and 200 and a softening point in the range of 70°–110°C.

9. A liquid toner as recited in claim 8 wherein a weight ratio of the stabilizer to a combination of the core and the stabilizer is in a range of 5% to 60%.

10. A liquid toner as recited in claim 1 wherein said resinous core has a Tg below 25° C. and a weight ratio of the stabilizer to a combination of the core and the stabilizer is in a corresponding range of 20% to 80%.

11. A liquid toner as recited in claim 1 wherein said stabilizer further comprises an anchoring component and a solubilizing component soluble in said carrier liquid, said anchoring component forming a covalent link from said stabilizer to said core.

12. A liquid toner as recited in claim 11 wherein said anchoring component comprises an ethylenically unsaturated moiety capable of forming a graft copolymer.

13. A liquid toner as recited in claim 11 wherein said anchoring component comprises a moiety derived from a monomer chosen from the group consisting of (a) an adduct of an alkenylazlactone with an unsaturated nucleophile containing at least one substituent chosen from the group consisting of hydroxy, amino, and mercaptan, (b) an adduct of a glycidylmethacrylate with a reactant chosen from acrylic acid and methacrylic acid, (c) allylmethacrylate.

14. A liquid toner as recited in claim 13 wherein said moiety is derived from a monomer chosen from the group consisting of adducts of an alkenylazlactone of the structure

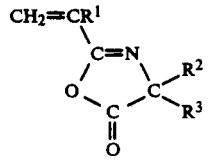

where $R^1$=H, or alkyl of less than or equal to $C_5$, $R^2$, $R^3$ are independently lower alkyl of less than equal to $C_8$, with an unsaturated nucleophile chosen from 2-hydroxyethylmethacrylate,
3-hydroxypropylmethacrylate,
2-hydroxyethylacrylate,
pentaerythritol triacrylate,
4-hyroxybutylvinylether,
9-octadecen-1-ol,
cinnamyl alcohol,
allyl mercaptan, and
methallylamine.

15. A liquid toner as recited in claim 14 wherein the alkenylazlactone is 2-vinyl-4,4-dimethylazlactone.

16. A liquid toner as recited in claim 11 wherein said solubilizing component is derived from a group of monomers and polymers containing at least one solubilizing moiety chosen from the group octadecyl methacrylate, lauryl methacrylate, 2-ethylhexylacrylate, poly(12-hydroxystearic acid), and 0.5–0.6 mole % methacryloxypropylmethyl polydimethylsiloxane, which is trimethylsiloxy terminated.

17. A liquid toner as recited in claim 1 wherein said moieties are derived from monomers chosen from the group consisting of $CH_2{=}C(R){-}R^5{-}Z$
$CH_2{=}CH{-}OOC{-}CH_2{-}Z$
$CH_2{=}CH(R)COO{-}R^5{-}Z$
$CH_2CH(R)CO{-}N(R^5){-}R^5{-}Z$

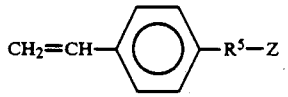

where

R=H or $CH_3$, $R^5$ is a single bond or a divalent linking group, and

Z is a bidentate or polydentate chelating group.

18. A liquid toner as recited in claim 15 wherein Z is chosen from the group consisting of

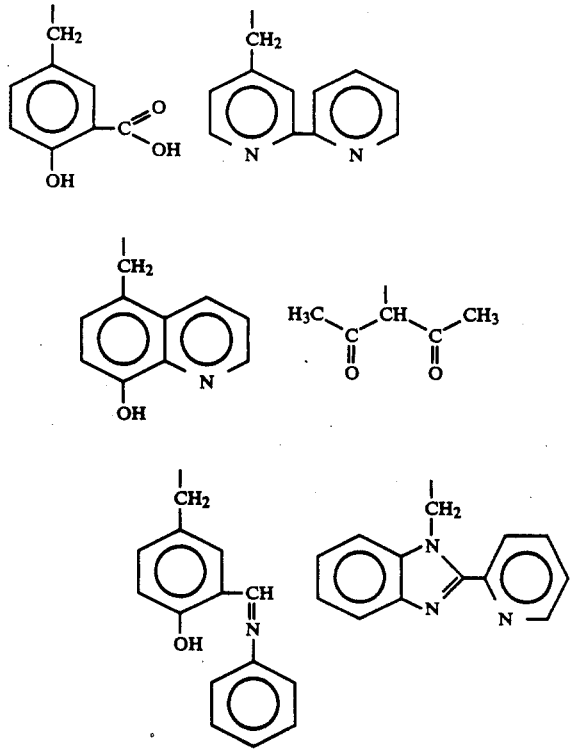

19. A liquid toner as recited in claim 1 wherein the metal soap is chosen from the group consisting of the salt of a fatty acid with a metal selected from the group consisting of Al, Ca, Co, Cr, Fe, Zn, and Zr.

20. A liquid toner as recited in claim 19 wherein the metal soap is chosen from the group consisting of zirconium neodecanoate and ferric laurate.

21. A liquid toner for use in developing an electrostatic image comprising an electrically insulating non-polar carrier liquid having dispersed therein toner particles comprising pigment particles having on their exterior surfaces polymer particles, said polymer particles having charge carrying coordination moieties attached to the surface of said polymer particles, and comprise a thermoplastic ester resin having an acid number of less than or equal to 200.

22. The toner of claim 21 wherein said polymer particles comprise a liquid, gel or solid, and said ester resin has an acid number between 1 and 200 and a softening temperature between 70° and 110° C.

23. The toner of claim 21 wherein the weight proportion of polymer to colorant is between 3:2 and 20:1.

24. The toner of claim 22 wherein the weight proportion of polymer particles to pigment in between 3:2 and 20:1.

25. The toner of claim 22 wherein the weight proportion of polymer particles to pigment is between 3.5:1 and 15:1.

26. A liquid toner for developing an electrostatic image comprising a dispersion of pigment and chelating polymer particles in a non-polar carrier liquid, said chelating polymer particles comprising a thermoplastic resinous core having a Tg of 25° C. or less which is insoluble in said carrier liquid, said carrier liquid having therein 0.01% by weight of said carrier liquid of a thermoplastic ester resin having an acid number of between 1 and 200.

27. A liquid toner for developing an electrostatic image comprising a dispersion of toner particles in a non-polar carrier liquid, said toner particles comprising pigment particles having thermoplastic chelating polymer particles on their surface, said thermoplastic chelating polymer particles comprising a thermoplastic resinous core having a Tg of less than 25° C. and a copolymeric steric stabilizer adhered to its surface, said copolymeric steric stabilizer having moieties attached thereto, said moieties being selected from the group consisting of coordinating groups and metal soap groups that form coordinate bonds with said coordinating groups, said dispersion of toner particles in a non-polar carrier liquid also having present as at least 0.01% by weight of said carrier liquid a thermoplastic ester resin having an acid number of from 1 to 200.

28. The toner of claim 27 wherein said copolymeric steric stabilizer has both coordinating groups and metal soap groups attached thereto.

29. The toner of claim 28 wherein said thermoplastic ester resin is associated with the surface of said toner particle.

30. The toner of claim 29 wherein said thermoplastic ester resin is an hydroxylated residue of an abietic acid or a pimaric acid.

* * * * *

UNITED STATES PATENT AND TRADEMARK OFFICE

CERTIFICATE OF CORRECTION

PATENT NO. : 4,988,602

DATED : Jan. 29, 1991

INVENTOR(S) : Jongewaard et al.

It is certified that error appears in the above-identified patent and that said Letters Patent is hereby corrected as shown below:

Col. 3, line 44, Replace "0.3 weight" with --0.3 weight %--

Col. 3, line 46, Replace "$(ohm\ cm)^{-11}$ with --$(ohm\ cm)^{-1}$--

Col. 3, line 65, Insert --in previous patent filed U.S. Patent Application Serial-- before "No. 07/279,424"

Col. 11, line 58, Replace "156 minutes" with --15 minutes--

Col. 13, line 40, Below "Carbon black (Regal 330)" insert --Perylene Green--

Col. 17, line 21, Replace "1A" with --2A--

Signed and Sealed this

Sixteenth Day of November, 1993

*Attest:*

Bruce Lehman

BRUCE LEHMAN

*Attesting Officer*

*Commissioner of Patents and Trademarks*